US005228190A

United States Patent [19]

Sawa

[11] Patent Number: 5,228,190

[45] Date of Patent: Jul. 20, 1993

[54] ROLLER TYPE HEMMING APPARATUS

[75] Inventor: Masazumi Sawa, Nagoya, Japan

[73] Assignee: Triengineering Company, Ltd., Japan

[21] Appl. No.: 911,922

[22] Filed: Jul. 10, 1992

[51] Int. Cl.[5] ..... B21D 19/08

[52] U.S. Cl. ..... 29/715; 29/243.57; 29/243.58; 29/283.5; 72/220; 901/29; 901/45

[58] Field of Search ..... 29/238, 243.58, 283.5, 29/715, 243.57; 72/210, 220; 901/5, 10, 29, 41, 45

[56] References Cited

FOREIGN PATENT DOCUMENTS 70325 3/1990 Japan ..... 72/220

*Primary Examiner*—P. W. Echols
*Assistant Examiner*—David P. Bryant
*Attorney, Agent, or Firm*—Palmatier, Sjoquist & Helget

[57] ABSTRACT

A roller type hemming apparatus for hemming a workpiece having a peripheral bent portion includes a hem roller rotated under pressure along the bent portion of the workpiece, a hem roller support adapted for displaceably supporting the hem roller, and a robot hand adapted for shifting the hem roller through the hem roller support while pressing the hem roller on the bent portion of the workpiece.

4 Claims, 9 Drawing Sheets

ROLLER TYPE HEMMING APPARATUS

BACKGROUND OF THE INVENTION

1. Field of the Invention

The present invention relates to a roller type hemming apparatus for hemming, for example, of a door panel for a vehicle.

2. Description of the Prior Art

Conventionally, a door panel has three edges which are formed by hemming layers of an outer panel and an inner panel. An example of a prior art apparatus to be used for such hemming is described in Japanese Laid-Open Patent Publication No. 61-262432 in which a roller type hemming apparatus is disclosed by the applicant of the present application.

The conventional hemming apparatus is illustrated generally at h in FIG. 11. As shown therein, the hemming apparatus h includes shifting means r such as a multi-axis controllable robot hand having a predetermined traveling path and a hem roller m carried by the shifting means r, and is adapted for hemming a bent portion We of a workpiece W which is positioned on a lower die k by the hem roller m rotated under pressure along the bent portion We. As illustrated, the bent portion We is bent in advance substantially at right angles, and the hem roller m is rotated under pressure along the extreme end of the bent portion We to achieve preliminary bending to a predetermined angle. Thereafter, the rolling operation is repeated to completely fold over the bent portion We, as shown in FIG. 12.

The roller type hemming apparatus h can be used for continuous hemming along the contour of the peripheral edge of a workpiece W, thus assuring good product accuracy as well as improved operating efficiency. The roller type hemming apparatus h as described above, however, involves the following problems.

Specifically, as shown in FIG. 12, hemming is achieved by shifting the hem roller m along the bent portion We in a pressed condition, and in order to achieve good hemming by folding over the bent portion We completely, the hem roller m must be shifted with its lower end always held at a constant distance $\delta$ away from a forming surface (or upper surface) ko of the lower die k. Therefore, an ideal traveling path (hereinafter referred to as "hemming level LH") must be defined for the hem roller shifting means r such as a robot hand. Such a constant distance $\delta$ is equal to the total of twice the thickness of an outer panel Wo and the thickness of an inner panel Wi.

The hem roller shifting means r is not, however, composed of a perfect rigid body, and when the hem roller m is pressed against the bent portion We for hemming, the shifting means r may be deflected through resiliency of itself and repulsive force of the bent portion We. Therefore, as shown in FIG. 13, the actual traveling path (hereinafter referred to as "traveling level LI") of the hem roller m is deviated by a distance B from the hemming level LH. This results in insufficient pressing force applied by the hem roller m and therefore imperfect folding over of the bent portion We, which will adversely affect satisfactory hemming. Thus, there has been a problem that the hemming level LH does not coincide with the actual traveling level LI due to the deflection of the hem roller shifting means r.

Furthermore, as the bent portion We of the workpiece W such as a door panel to be hemmed usually includes complex and continuous curves or the like, it has been quite difficult and sometimes practically impossible to define such a traveling path for the hem roller shifting means r as to permit accurate follow-up of the hem roller m along the contour of the bent portion We. Therefore, the traveling path of the hem roller m during the actual hemming operation includes slight difference from the contour of the bent portion We, which causes another difficulty in achieving good hemming.

When a multi-axis controllable robot hand as described above is used for the hem roller shifting means r, it is required to teach a predetermined traveling path to the robot hand. It is, however, impossible to directly and accurately teach such an ideal traveling path of the hem roller m as required, or the hemming level LH. This is because the hemming level LH is a spatial path held at a constant distance away from the forming surface ko of the lower die k. Thus, in case the robot hand is used for the hem roller shifting means r, this teaching procedure has been quite difficult.

SUMMARY OF THE INVENTION

It is an object of the present invention to provide a roller type hemming apparatus wherein a hem roller can accurately follow up the configuration of a bent portion of a workpiece to be hemmed.

It is another object of the present invention to provide a roller type hemming apparatus which can readily and directly teach an ideal traveling path of a hem roller to a robot hand.

In order to overcome the above problems associated with the prior art, the present invention provides a roller type hemming apparatus for hemming a workpiece having a peripheral bent portion which includes a hem roller rotated under pressure along the bent portion of the workpiece, a hem roller support adapted for displaceably supporting the hem roller, and a robot hand adapted for shifting the hem roller through the hem roller support while pressing the hem roller on the bent portion of the workpiece.

With the above construction, as the hem roller is displaceable in a direction corresponding to the pressing direction of the robot hand, deflection of the robot hand or any difference between the traveling path of the robot hand and the peripheral contour of the workpiece can be absorbed, permitting the hem roller to accurately follow up the bent portion of the workpiece.

In teaching the robot hand, a forming surface of a lower die is used as a virtual traveling path, and during the hemming operation, the hem roller support corrects or absorbs any difference between the path thus taught and a path which is actually required, so that the hem roller can be rotated under pressure along the bent portion of the workpiece in an optimum traveling path.

BRIEF DESCRIPTION OF THE DRAWINGS

Preferred embodiments of the present invention will now be described by way of example only and with reference to the accompanying drawings, wherein.

DETAILED DESCRIPTION OF THE PREFERRED EMBODIMENTS

Figure 1:
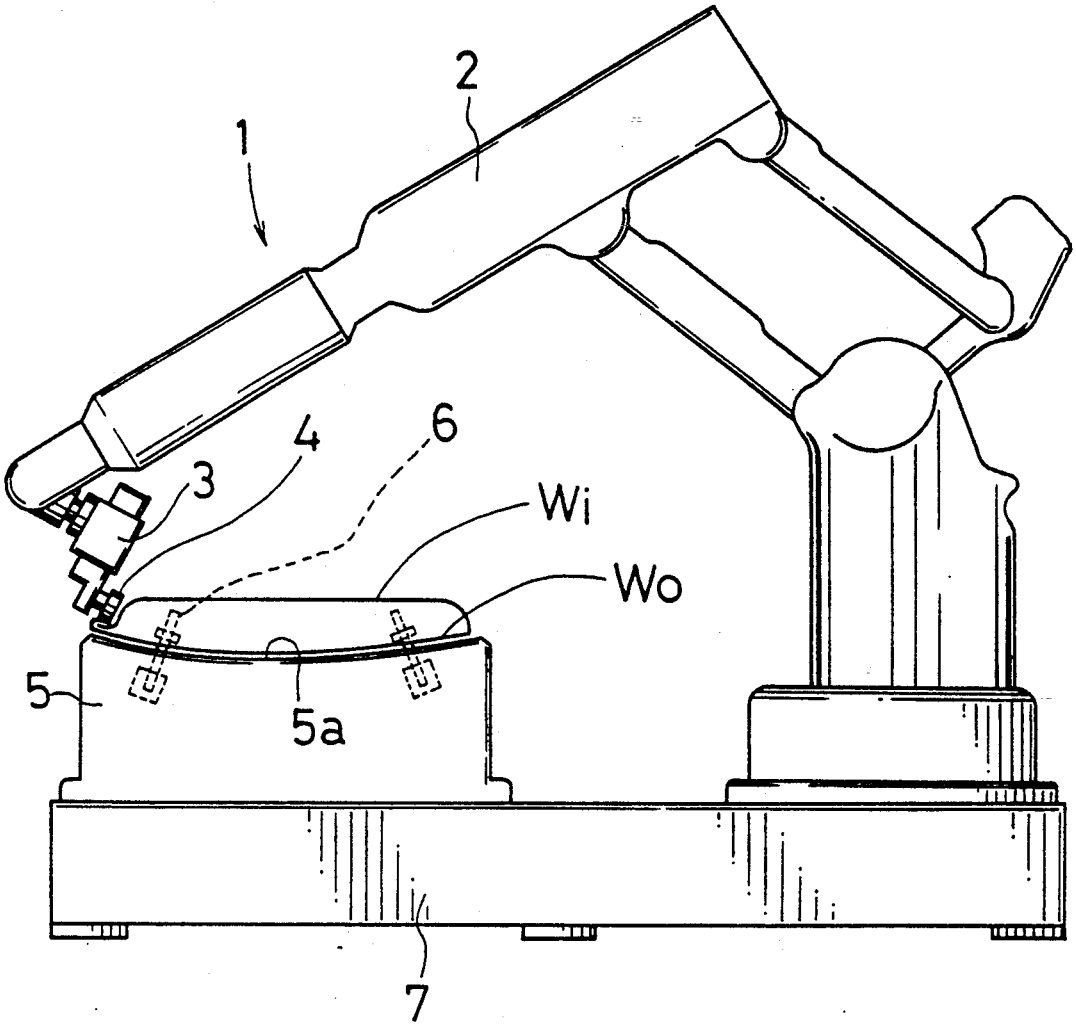
FIG. 1 is a general view of a roller type hemming apparatus using a robot hand in accordance with the present invention.

Referring to the drawings and to FIG. 1 in particular, shown therein is a roller type hemming apparatus 1 embodying the principles of the present invention. As shown therein, the hemming apparatus 1 is comprised of a multi-axis controllable robot hand 2 to which a predetermined traveling path is preliminarily taught, a hem roller support 3 mounted on the forward end of the robot hand 2, and a hem roller 4 displaceably supported by the hem roller support 3 to be pressed against a workpiece W.

Figure 11:
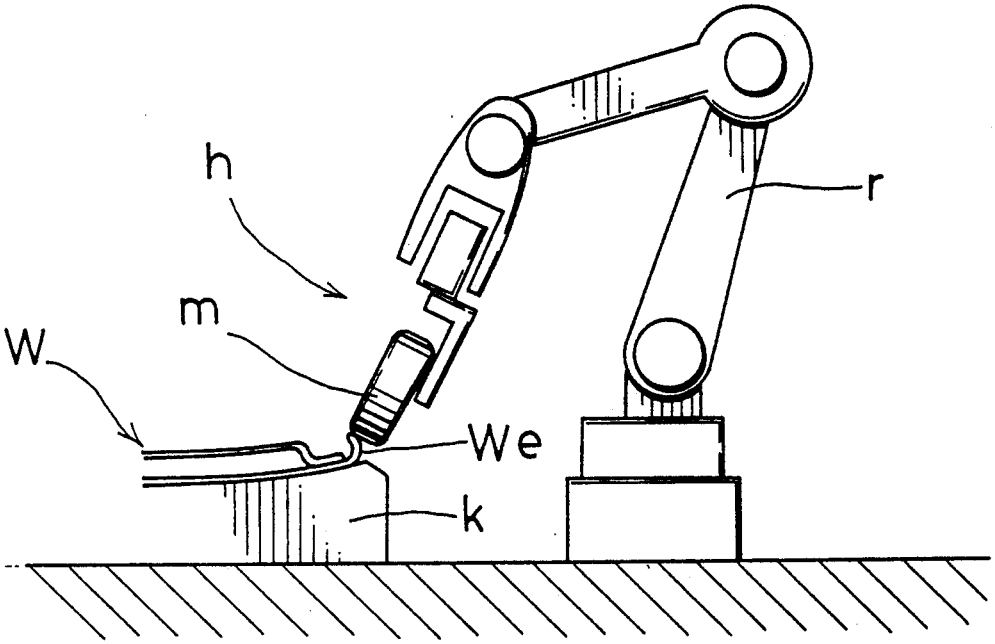
FIG. 11 PRIOR ART
FIG. 11 is a general view of a prior art roller type hemming apparatus using a robot hand.
Figure 12:
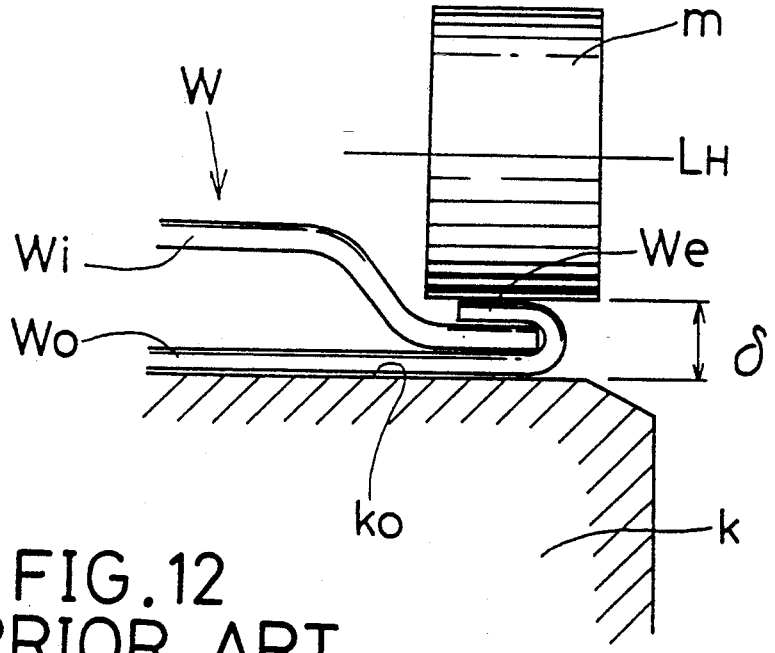
FIG. 12 PRIOR ART
FIG. 12 is a schematic view illustrating shifting operation of the hem roller in FIG. 11 on a hemming level.
Figure 13:
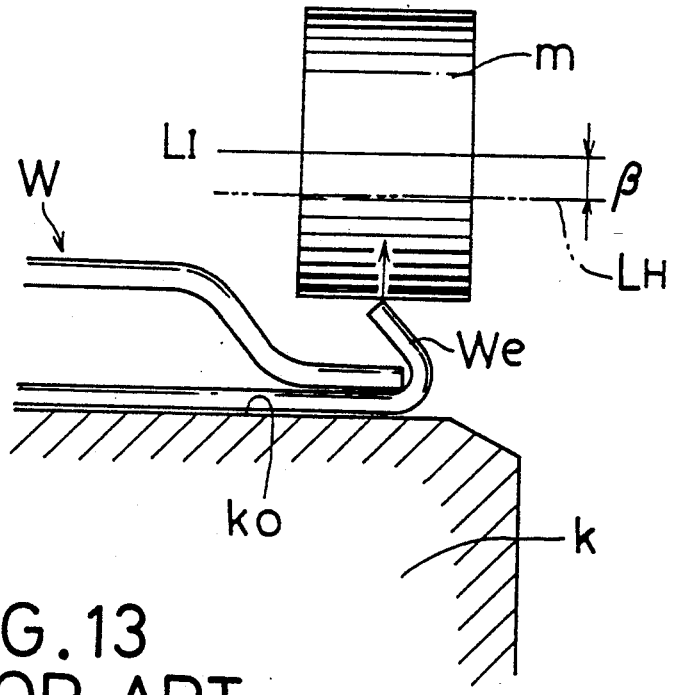
FIG. 13 PRIOR ART
FIG. 13 is a view similar to FIG. 12 but illustrating an actual traveling level of the hem roller.

The workpiece W is, for example, a door panel composed of an outer panel Wo and an inner panel Wi. The outer panel Wo has a peripheral portion preliminarily bent upwardly substantially at right angles, and the inner panel Wi has a peripheral stepped portion extending outwardly (see FIG. 11). The outer panel Wo and the inner panel Wi are placed on a lower die 5 with the stepped portion of the inner panel Wi arranged along the inside of the bent portion of the outer panel Wo. The lower die 5 has an upper surface constituting a forming surface 5*a* and is placed on a common base 7 on which the hemming apparatus 1 is placed at a predetermined distance away from the lower die 5. The workpiece W is Placed on the forming surface 5*a* of the lower die 5 and is secured thereto by fixtures 6.

As the robot hand 2 is well known in the art, its description will be omitted, and the hem roller support 3 and the hem roller 4 will be explained in detail.

Figure 2:
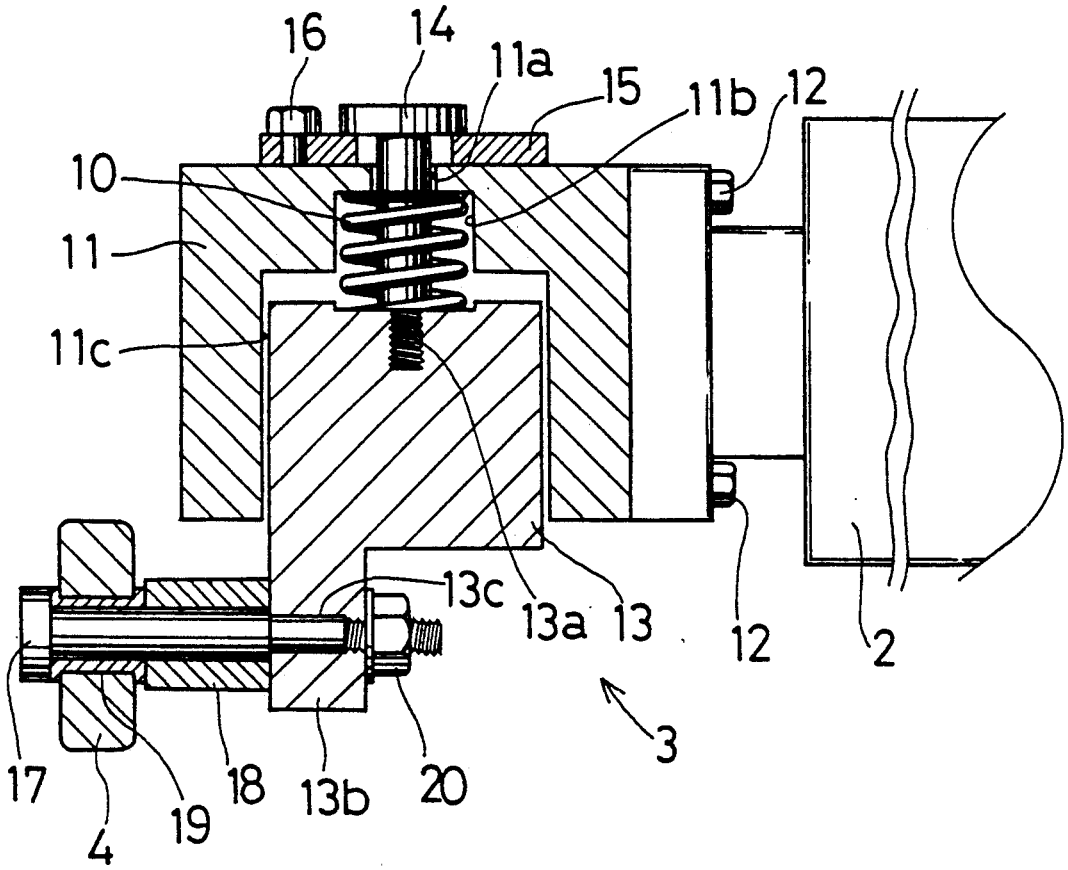
FIG. 2 is a vertical sectional view of a first embodiment of a hem roller support.

As shown in FIG. 2, a support bracket 11 is attached to the forward end of the robot hand 2 by bolts 12. The support bracket 11 is a block member of a predetermined shape having a slide hole 11*c*, a spring hole 11*b* and a through hole 11*a* coaxially formed in subsequent steps from the lower side (as viewed in FIG. 2). The slide hole 11*c* is an angular hole, for example, of a square cross section, while the spring hole 11*b* and the through hole 11*a* are circular holes having predetermined diameters, respectively.

A slide block 13 is slidably inserted in the support bracket 11 thus constructed. The slide block 13 is a substantially prismatic member slidably inserted in the slide hole 11*c* of the support bracket 11, and has a threaded hole 13*a* formed substantially in the central portion of the inserted upper surface thereof. A stopper bolt 14 is fixed in the threaded hole 13*a*. The stopper bolt 14 is inserted through the through hole 11*a* of the support bracket 11 from above (as viewed in FIG. 2), and is secured to the slide block 13 by screwing into the threaded hole 13*a*, with a spring 10 encircling a shank portion thereof.

The spring 10 is a compression coil spring having a predetermined spring constant and has upper and lower ends held in abutment against the bottom of the spring hole 11*b* formed in the support bracket 11 and the upper surface of the slide block 13, respectively, so as to urge the slide block 13 downwardly (as viewed in FIG. 2) of the support block 11.

A spacer plate 15 of a predetermined thickness t is provided between the upper surface of the support bracket 11 and the head of the stopper bolt 14 and is removably secured therebetween by a set screw 16.

The slide block 13 has a support lug 13*b* projecting downwardly (as viewed in FIG. 2) from the foremost portion of the lower surface of the slide block 13. The support lug 13*b* has a support hole 13*c* of a predetermined diameter extending through the thickness thereof. A support shaft 17 is inserted through the support hole 13*c* in such a manner as to extend forwardly beyond the support lug 13*b*, and is fixed by a nut 20.

The hem roller 4 is rotatably mounted on the support shaft 17 at the front end thereof through a metal bush 19. A collar 18 is interposed between the metal bush 19 and the support lug 13*b*.

A teaching procedure to the robot hand 2 will now be described with reference to FIG. 3.

Figure 3:
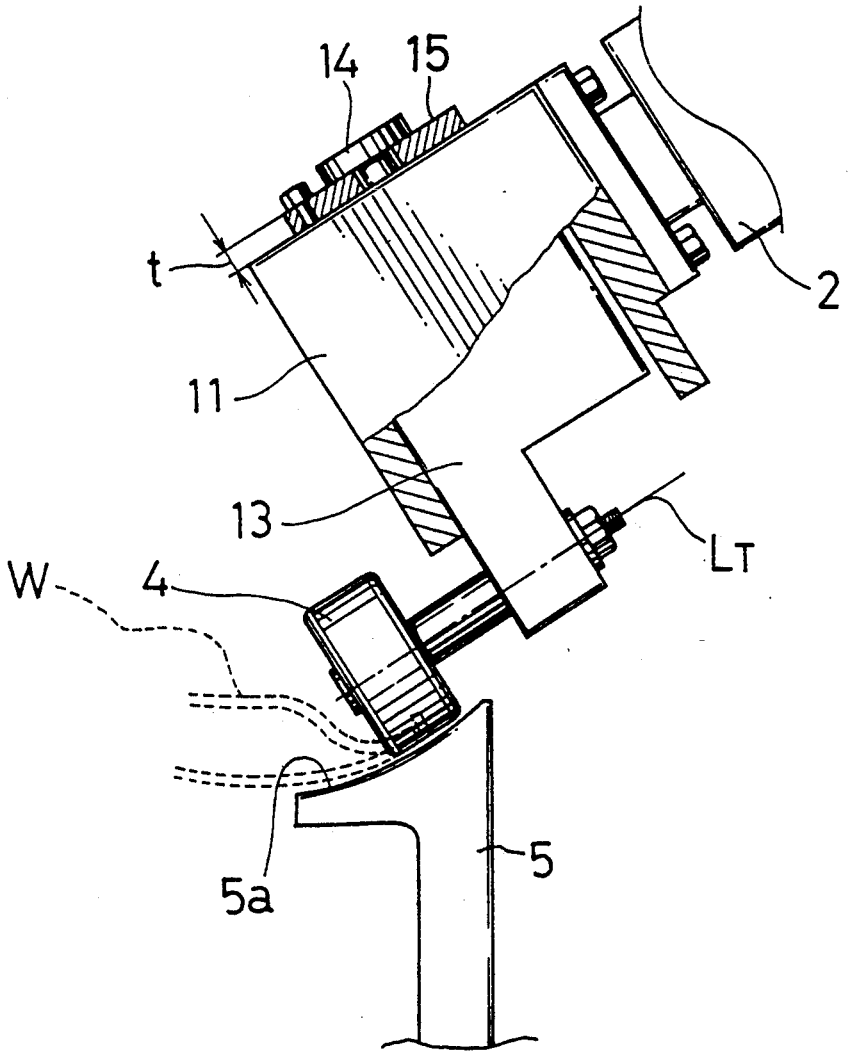
FIG. 3 is a schematic view illustrating the teaching operation.

The spacer plate 15 is preliminarily interposed between the support bracket 11 and the head of the stopper bolt 14, as shown in FIG. 3. This causes the slide block 13 and consequently the hem roller 4 to be displaced upwardly (as viewed in FIG. 3) with respect to the support bracket 11 or in the direction away from the forming surface 5*a* of the lower die 5, by a distance corresponding to the thickness t of the spacer plate 15.

Then, the hem roller 4 is moved along the forming surface 5*a* of the lower die 5 in abutment therewith so as to teach to the robot hand 2 a virtual traveling path defined by the forming surface 5*a*. The position of the hem roller 4 with respect to the forming surface 5*a* at this time is shown as teaching level LT. After the teaching operation has been completed, the spacer plate 15 is removed to return the slide block 13 to a free position where the head of the stopper bolt 14 is in abutment against the upper surface of the support bracket 11.

As described above, in teaching to the robot hand 2, the virtual traveling path temporarily defined by the forming surface 5*a* of the lower die 5 is taught to the robot hand 2, so that the robot hand 2 is shifted in the traveling path thus taught to perform hemming operation.

Figure 4:
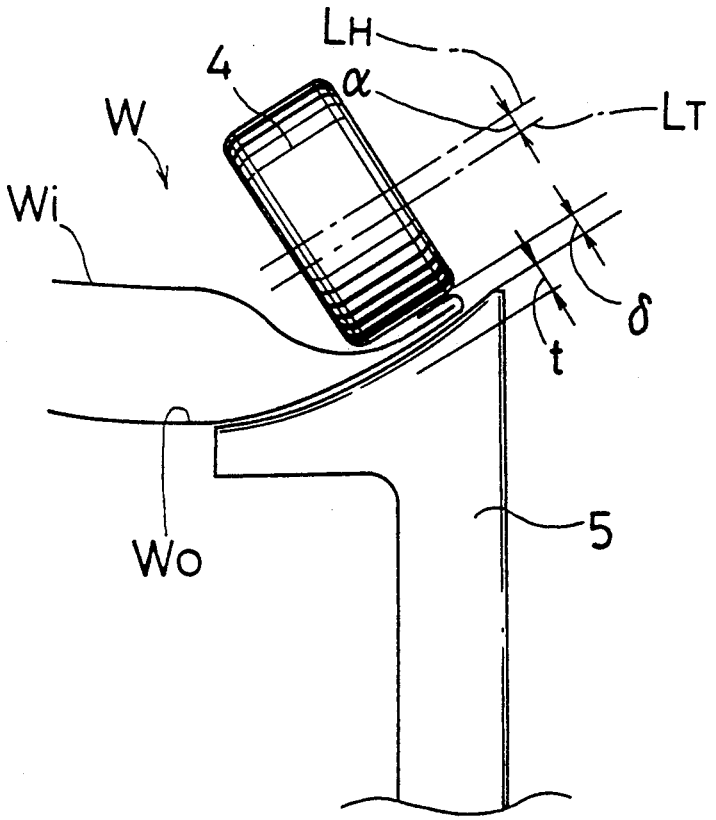
FIG. 4 is a schematic view illustrating the hemming operation.

During the hemming operation, the workpiece W is placed on the forming surface 5*a* of the lower die 5, as shown in FIG. 4, so that the hemming level LH which defines an ideal traveling path of the hem roller 4 is deviated by a distance $\alpha$ from the teaching level LT in the direction away from the forming surface 5*a* of the lower die 5. The distance $\alpha$ corresponds to thickness $\delta$ of the workpiece W which is the total of twice the thickness of the outer panel Wo and the thickness of the inner panel Wi. Here, it is to be noted that the robot hand 2 is so moved as to locate the hem roller 4 at the teaching level LT. However, the hem roller 4 cannot be located at the level LT since the spacer plate 15 is removed during the hemming operation, and since the workpiece W is placed between the hem roller 4 and the lower die 5. Then, the spring 10 provided between the support bracket 11 and the slide block 13 is contracted to the amount of difference in height of the hem roller 4, that is, the total of the thickness t of the spacer plate 15 and the thickness δ of the workpiece W, and as the spring 10 is contracted, the hem roller 4 is pressed toward the lower die 5 by repulsive force of the contracting spring 10. Specifically, the difference between the teaching level LT and the hemming level LH is absorbed by contraction of the spring 10, so that good hemming operation may be performed even though the virtual traveling path temporarily defined by the forming surface 5*a* of the lower die 5 has been taught to the robot hand 2.

Further, during the hemming operation, the hem roller 4 is pressed with a predetermined pressing force against the bent portion of the workpiece W, and repulsive force of the bent portion for the pressing force causes the robot hand 2 to be deflected in the direction away from the bent portion. As, in teaching to the robot hand 2, the position of the slide block 13 has been displaced with respect to the support bracket 11 by a distance corresponding to the thickness t of the spacer plate 15, the hem roller 4 can be maintained on the hemming level LH, even when the robot hand 2 is deflected within the range limited by the maximum distance corresponding to the thickness t. Thus, the deflection of the robot hand 2 is absorbed and the hem roller 4 is always held on the hemming level LH, permitting the pressing force of the hem roller 4 to be maintained at a proper value to achieve good hemming.

As described above, as the slide block 13 and consequently the hem roller 4 is displaceable with respect to the support bracket 11 and consequently the robot hand 2, deflection of the robot hand 2, or difference in the traveling path of the hem roller 4 with respect to the workpiece W can be absorbed, permitting the hem roller 4 to constantly follow up the bent portion of the workpiece W exactly and to be constantly pressed with a proper pressing force for good hemming.

Further, as the hem roller 4 is displaceable with respect to the robot hand 2, the teaching procedure can be readily performed, using the forming surface 5*a* of the lower die 5 as virtual traveling path.

Figure 5:
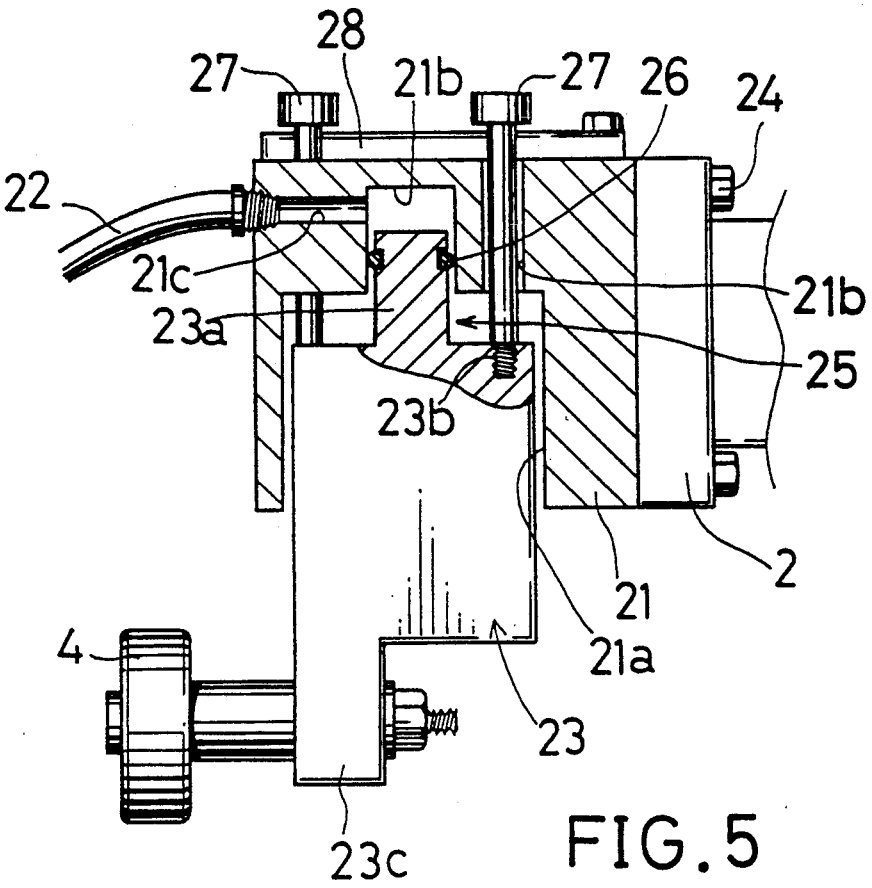
FIG. 5 is a vertical sectional view of a second embodiment of the hem roller support.
Figure 6:
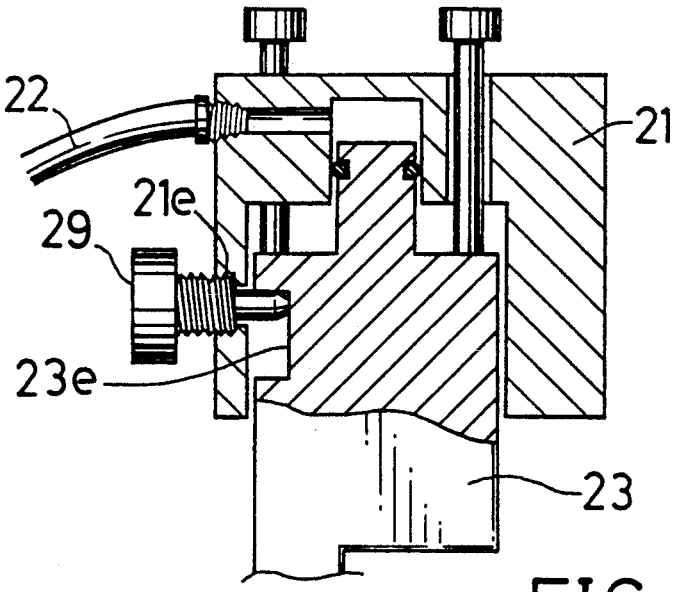
FIG. 6 is a vertical sectional view of the hem roller support of the second embodiment, illustrating another way of teaching level setting.

FIGS. 5 and 6 show a second embodiment of the present invention. The second embodiment is similar to the first embodiment except the hem roller support. In this embodiment, a single-acting hydraulic cylinder section 25 is provided between the support bracket and the slide block. Like parts are given like reference numbers and their description will not be repeated.

As shown in FIG. 5, a support bracket 21 is secured to the forward end of the robot hand 2 by bolts 24. The support bracket 21 also has a slide hole 21*a* of a square cross section having a predetermined depth and opening downwardly (as viewed in FIG. 5). The support bracket 21 further has a hydraulic hole 21*b* of a circular cross section having a predetermined diameter and formed in the bottom of the slide hole 21*a* coaxially therewith.

The support bracket 21 further has an oil hole 21*c* extending from the bottom of the hydraulic hole 21*b* and opening to the forward end of the support bracket 21. A hydraulic hose 22 is connected to the opening of the oil hole 21*c*. The hydraulic hose 22 is connected to hydraulic power means such as a hydraulic pump (not shown). A slide block 23 which will be described later is inserted in the slide hole 21*a* to define a hydraulic chamber within the hydraulic hole 21*b*. Thus, the hydraulic cylinder section 25 is formed between the support bracket 21 and the slide block 23. When oil is supplied to the hydraulic chamber, the slide block 23 may be pushed downwardly (as viewed in FIG. 5). When the slide block 23 is pressed upwardly, the oil is exhausted through the hydraulic hole 21*b* to permit upward movement of the slide block 23.

The support bracket 21 further has a pair of through holes 21*d* extending from the bottom of the slide hole 21*a* to the upper surface of the support bracket 21 and arranged on opposite sides of the hydraulic hole 21*b*. The through holes 21*d* are so positioned as to avoid interference with the oil hole 21*c*.

The slide block 23 is a substantially prismatic member slidably inserted in the slide hole 21*a* of the support bracket 21, and is provided with a cylindrical piston portion 23*a* projecting from the central portion of the inserted end surface (upper surface as viewed in FIG. 5) of the slide block 23 to be inserted into the hydraulic hole 21*b* in the support bracket 21. A seal ring 26 is provided in the vicinity of the upper end of the piston portion 23*a* so as to maintain the hydraulic hole 21*b* in an oil-tight manner.

A pair of threaded holes 23*b* are formed in the inserted end surface of the slide block 23 at positions corresponding to the through holes 21*d* formed in the support bracket 21. Stopper bolts 27 are screwed in the threaded holes 23*b*. The stopper bolts 27 are of the same form as the ones shown in the first embodiment and are inserted from above (as viewed in FIG. 5) through the through holes 21*d* in the support bracket 21 to be fastened into the threaded holes 23*b* in the slide block 23.

The slide block 23 has a support lug 23*c* projecting downwardly from the foremost portion of the bottom surface of the slide block 23. The hem roller 4 is rotatably supported by the support lug 23*c* in the same manner as described with reference to the first embodiment.

As with the first embodiment, a spacer plate 28 is to be interposed between the upper surface of the support bracket 21 and the heads of the stopper bolts 27.

The second embodiment thus constructed is operated similarly to the first embodiment.

Specifically, a virtual traveling path defined by the forming surface 5*a* of the lower die 5 is taught, with the spacer plate 28 interposed between the upper surface of the support bracket 21 and the heads of the stopper bolts 27. Difference between the teaching level LT and the hemming level LH, or deflection of the robot hand 2 can be absorbed by supplying or exhausting oil through the hydraulic hole 21*b* so as to displace the slide block 23 and consequently the hem roller 4 with respect to the support bracket 21. This allows the hem roller 4 to accurately follow up the workpiece W and to be constantly pressed with a proper pressing force to achieve good hemming.

As shown in FIG. 6, the spacer plate 28 may be replaced by a lock screw 29 which is adapted for defining the lowermost limit of displacement (teaching level LT) of the slide block 23 in the teaching procedure. Specifically, the slide block 23 has an elongated groove 23*e* formed in the front surface on the left side (as viewed in FIG. 6), and the support bracket 21 has a threaded hole 21*e* formed in confronting relation to the elongated groove 23*e*. To the slide block 23, the lock screw 28 is screwed in the threaded hole 21*e* until its tip is engaged in the elongated groove 23*e*.

Figure 7:
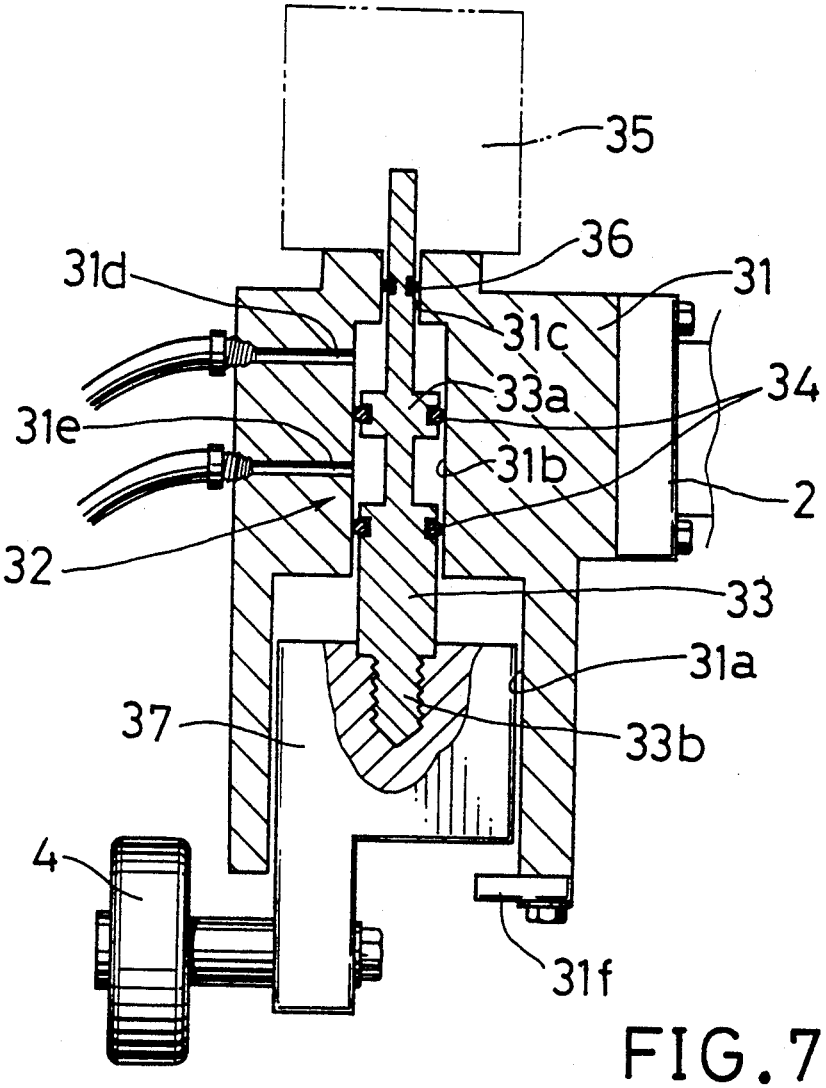
FIG. 7 is a vertical sectional view of a third embodiment of the hem roller support.
Figure 8:
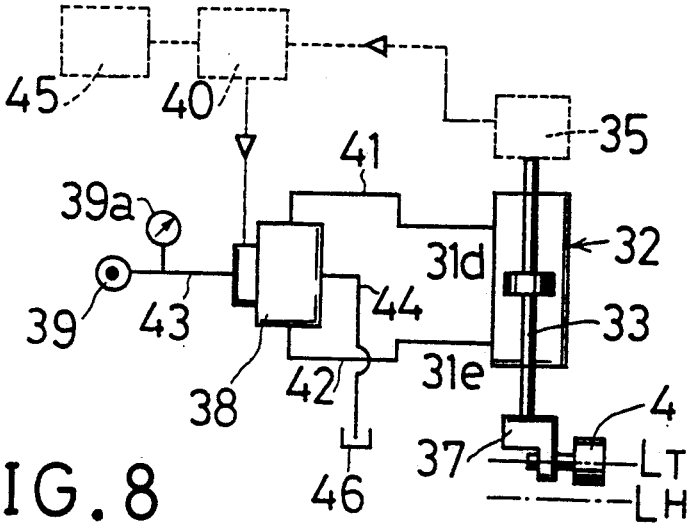
FIG. 8 is a hydraulic control circuit diagram for a hydraulic cylinder in the third embodiment.

FIGS. 7 and 8 show a third embodiment of the present invention. In this embodiment, a hydraulic servo system is employed for controlling the position of the hem roller 4. Like parts are given like reference numbers and their description will not be repeated.

As shown in FIG. 7, a support bracket 31 includes a double-acting hydraulic cylinder section 32 controlled by a hydraulic control circuit shown in FIG. 8. The support bracket 31 has a slide hole 31*a* of a square cross section, as with the first and second embodiments. A cylinder bore 31*b* is coaxially formed from the bottom surface of the slide hole 31*a*, and also a through hole 31*c* is coaxially formed from the bottom of the cylinder bore 31*b* and is opened to the upper surface of the support bracket 31. A stopper plate 31*f* is secured to the opening of the slide hole 31*a* or the lowermost end of the support bracket 31 so as to project therefrom.

The cylinder bore 31*b* has a pair of hydraulic ports 31*d* and 31*e* axially spaced from each other and connected to a hydraulic pump through respective hydraulic hoses. A piston shaft 33 is slidably inserted in the cylinder bore 31*b* thus constructed. The piston shaft 33 has substantially in the central portion of the length thereof a piston 33*a* integrally formed therewith, and a seal ring 34 is provided around the piston 33*a*. The hydraulic ports 31*d* and 31*e* are opened to the cylinder bore 31*b* at positions above and below the piston 33*a*, respectively, so that supply and exhaust of oil through the hydraulic ports 31*d* and 31*e* causes the piston shaft 33 to be displaced up and down.

The upper end of the piston shaft 33 projects through the through hole 31*c* upwardly beyond the upper surface of the support bracket 31 and is connected to a linear encoder 35 used for position detection. A seal ring 36 is provided between the upper end of the piston shaft 33 and the through hole 31*c* so as to maintain the cylinder bore 31*b* in an oil-tight manner. The lower portion of the piston shaft 33 projects downwardly into the slide hole 31*a*, and is connected to a slide block 37 through a threaded portion 33*b* provided at the lowermost end of the piston shaft 33.

The hydraulic cylinder section 32 thus constructed is actuated to vertically move the slide block 37 and thereby to displace the position thereof with respect to the support bracket 31, which position of the slide block 37 is detected by the linear encoder 35. The slide block 37 and the hem roller 4 supported thereby are formed similarly to the corresponding parts of the first embodiment.

The hem roller support of the third embodiment is thus constructed, and the hydraulic cylinder section 32 is actuated to reciprocatingly move the slide block 37 and consequently the hem roller 4 between the bottom of the slide hole 31*a* and the stopper plate 31*f*, and the position of the hem roller 4 can be constantly controlled through the linear encoder 35 by the hydraulic control circuit shown in FIG. 8.

Now, the description will be related to the hydraulic control circuit for the hydraulic cylinder section 32 with reference to FIG. 8.

The hydraulic ports 31*d* and 31*e* of the hydraulic cylinder section 32 are connected through hydraulic hoses 41 and 42 to the hydraulic servo valve 38 which is, in turn, connected through a hydraulic hose 43 to a hydraulic pump 39. The hydraulic servo valve 38 is changed over to send hydraulic pressure generated by the hydraulic pump 39 to the hydraulic port 31*d* or 31*e* and thereby to vertically reciprocate the piston shaft 33 in the cylinder bore 31*b*.

The linear encoder 35 and the hydraulic servo valve 38 are electrically connected through a servo amplifier 40 to an external control unit 45 such as a sequencer. The linear encoder 35 detects the position of the hem roller 4, and in accordance with the detected position, the hydraulic servo valve 38 is changed over to adjust the position of the hem roller 4.

The hydraulic servo valve 38 has a return port 44 adapted for returning oil exhausted from the hydraulic cylinder section 32 to a tank 46. A hydraulic meter 39*a* for the hydraulic pump 39 is provided.

The hem roller support thus constructed is operated similarly to the preceding embodiments.

In the teaching operation to the robot hand 2, the external control unit 45 is operated to change over the hydraulic servo valve 38 to move the slide block 37 upwardly (as viewed in FIG. 7) by a predetermined distance from the lowermost position of the slide block 37 (position in abutment against the stopper plate 31*f*) so as to position the hem roller 4 on the teaching level LT, and in this condition, teaching is carried out similarly to the preceding embodiments.

During the hemming operation, the hem roller 4 is returned to the lowermost position from the teaching level LT to be pressed against the workpiece W. The difference between the teaching level LT and the hemming level LH, or deflection of the robot hand 2 when pressed can be absorbed by detecting the actual Position of the hem roller 4 by the linear encoder 35, changing over the hydraulic servo valve 38 by the external control unit 45 in accordance with the detected Position and displacing the slide block 37 and consequently the hem roller 4 so as to be constantly held on the hemming level LH. Therefore, the hem roller 4 can constantly follow up the workpiece W accurately and be pressed with a proper pressing force to assure good hemming at all times.

Figure 9:
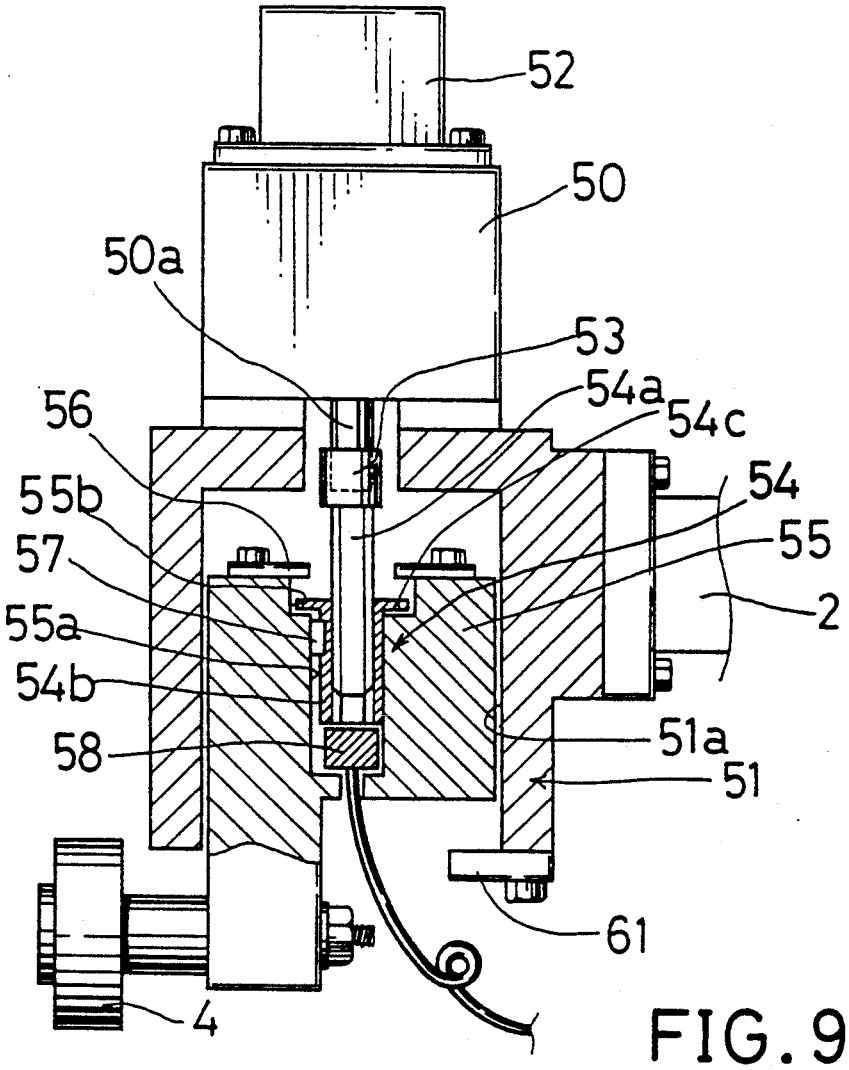
FIG. 9 is a vertical sectional view of a fourth embodiment of the hem roller support.
Figure 10:
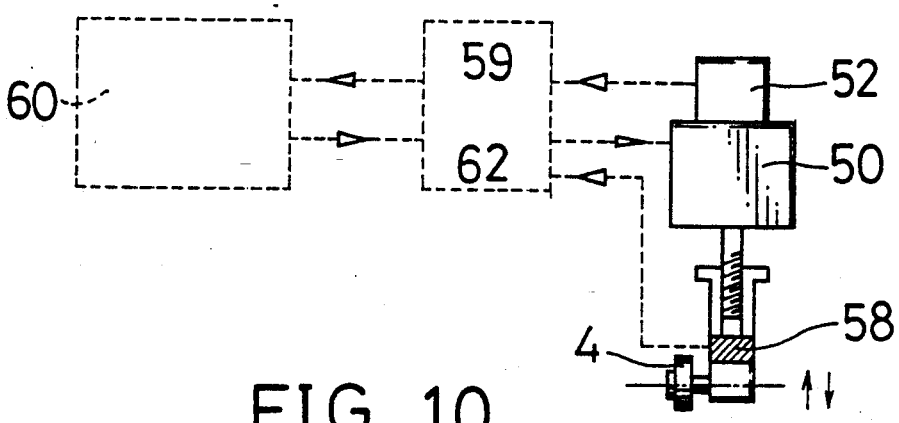
FIG. 10 is a drive control circuit diagram for a servo motor in the fourth embodiment.

FIGS. 9 and 10 show a fourth embodiment of the present invention. This embodiment employs a motor servo system in place of the hydraulic servo system of the third embodiment. Like parts are given like reference numbers and their description will not be repeated.

As shown in FIG. 9, a servo motor 50 with a rotary encoder 52 is mounted on the upper surface of a support bracket 51. The motor 50 has an output shaft 50*a* which is coaxially connected with a threaded shaft 54*a* of a ball screw 54 through a coupling 53. The threaded shaft 54*a* is projected into a slide hole 51*a* formed in the support bracket 51.

A slide block 55 has in the upper surface thereof a support hole 55*a* of a predetermined diameter, in which a nut 54*b* of the ball screw 54 is axially slidably inserted. The support hole 55*a* has at the opening thereof an enlarged-diameter engaging hole 55*b* of a predetermined depth. The engaging hole 55*b* is adapted for receiving a flange portion 54*c* of the nut 54*b*. A retainer 56 is attached to the opening of the engaging hole 55*b* so as to prevent the nut 54*b* from falling out, and a key 57 is provided for preventing rotation of the nut 54*b* with respect to the slide block 55. Thus, the nut 54*b* is slidable within the support hole 55*a* in the range defined by the range of movement of the flange portion 54*c* between the bottom of the engaging hole 55*b* and the retainer 56, and therefore, the nut 54*b* is displaceable with respect to the slide block 55 in this range.

A load cell 58 is mounted between the lower end of the nut 54*b* and the bottom of the support hole 55*a* and is electrically connected to an external control unit 60 through a servo amplifier 59 which will be mentioned later.

A stopper plate 61 is attached to the opening of the slide hole 51*a* or the lowermost end of the support bracket 51 similarly to the third embodiment and is adapted for defining the lowermost limit of displacement of the slide block 55 or preventing falling out thereof. The hem roller 4 is supported by the slide block 55 similarly to the preceding embodiments.

The slide block 55 supporting the hem roller 4 in this way is slidingly moved up or down for a predetermined distance by driving the motor 50 predetermined revolutions in the forward or reverse direction. The position of the slide block 55 and consequently the hem roller 4 can be detected through detection of the number of revolutions of the motor 50 by the rotary encoder 52. The pressing force of the hem roller 4 is detected by the load cell 58, and the number of revolutions of the motor 50 is controlled so that such a detected pressing force may be constantly held at a proper value and thereby the hem roller 4 may be held on the hemming level LH.

As shown in FIG. 10, the rotary encoder 52 and the load cell 58 are electrically connected through the servo amplifier 59 to the external control unit 60 such as a sequencer, while the servo motor 50 is connected to a motor driver 62 which is also connected to the external control unit 60.

The hem roller support thus constructed is operated similarly to the preceding embodiments.

Specifically, in teaching to the robot hand 2, the motor 50 is driven predetermined revolutions to displace the slide block 55 by a predetermined distance upwardly from the lowermost position where it is in abutment against the stopper plate 61, so that the hem roller 4 is positioned on the teaching level LT. In this condition, teaching is carried out similarly to the preceding embodiments. At this time, the nut 54*b* is moved upwardly with respect to the support hole 55*a* to a position where the flange portion 54*c* is in abutment against the retainer 56.

During the practical hemming operation, the motor 50 is further driven predetermined revolutions to displace the slide block 55 by the distance $\alpha$ upwardly from the teaching level LT, so that the hem roller 4 may be displaced to the hemming level LH.

In this condition, the hem roller 4 is rotated under pressure against the bent portion of the workpiece W to achieve hemming. If the robot hand 2 is deflected out of the teaching level LT, the hem roller 4 is also displaced from the hemming level LH, which may results in insufficient pressing force of the hem roller 4. In such a case, the motor 50 is rotated, until the load cell 58 detects a predetermined pressing force, so as to displace the hem roller 4 to the hemming level LH. The deflection of the robot hand 2 is absorbed in this way, and thus the hem roller 4 is constantly held on the hemming level LH to achieve good hemming.

What is essential to the present invention is that the hem roller 4 is displaceable with respect to the robot hand 2, the position of the hem roller 4 being controlled by position controlling means of the hem roller support 3 and thereby teaching to the robot hand 2 can be readily carried out, and during the hemming operation, the position of hem roller 4 can be constantly held on the hemming level LH to achieve good hemming at all times.

Thus, in the hemming apparatus of the present invention, as the hem roller is rotated under a proper pressing force in an accurate traveling path along the peripheral contour of a workpiece, hemming can be always satisfactorily carried out. In addition, teaching to the robot hand can be readily carried out in the present invention.

While the invention has been described with reference to preferred embodiments thereof, it is to be understood that modifications or variations may be easily made without departing from the scope of the present invention which is defined by the appended claims.

What is claimed is:

1. A roller type hemming apparatus for hemming a workpiece having a peripheral bent portion, adapted for operable connection to a multi-axis robot hand, comprising:

a hem roller support, comprising a support bracket mounted to said robot hand, said support bracket having a hole extending therethrough along a first axis; a slide block slidably movable along said first axis and supported within said support bracket, said slide block having a support lug on a lower end thereof aligned along a second axis; a spring positioned between said slide block and said support bracket for urging said slide block along said first axis; a stopper bolt secured to said slide block and passing through said spring and said hole, and having a head projecting outwardly from said hole, said stopper bolt limiting the slidable travel of said slide block along said first axis; and a spacer plate positioned between the head of the stopper bolt and the support bracket; and a hem roller rotatably mounted to said support lug.

2. A roller type hemming apparatus adapted for operable connection to a multi-axis robot hand, for hemming a workpiece having a peripheral bent portion, comprising:

a support bracket mounted to said robot hand, said support bracket having a cylindrical hole extending therethrough along a first axis;

a slide block slidably supported along said first axis within said support bracket, said slide block having a support lug on a lower end thereof;

single-acting hydraulic cylinder means provided between said slide block and said support bracket for shifting said slide block along said first axis;

a stopper bolt secured to the upper end of said slide block, said stopper bolt extending through said cylindrical hole and having a head extending outwardly from said support bracket;

a spacer plate positioned between the head of said stopper bolt and said support bracket; and a hem roller rotatably mounted to said support lug.

3. A roller type hemming apparatus adapted for operable connection to a multi-axis robot hand, for hemming a workpiece having a peripheral bent portion, comprising:

a support bracket mounted on the forward end of said robot hand;

a slide block slidably supported within said support bracket, said slide block having a support lug on the lower end thereof;

a double-acting hydraulic cylinder means provided in said support bracket for slidably moving said slide block, said hydraulic cylinder means including a piston shaft;

a linear encoder for detecting the position of said slide block by detecting the stroke amount of said piston shaft of said hydraulic cylinder means;

control means for controlling the operation of said hydraulic cylinder means based on the position of said slide block detected by said linear encoder; and a hem roller rotatably connected to said support lug.

4. A roller type hemming apparatus adapted for operable connection to a multi-axis robot hand, for hemming a workpiece having a peripheral bent portion, comprising:

a support bracket mounted on the end of said robot hand;

a servo motor mounted on said support bracket and having an output shaft;

a ball screw mounted on the output shaft of said servo motor and having a threaded shaft and a nut;

a slide block operatively connected to said nut of said ball screw for sliding movement in a predetermined range and supported within said support bracket for sliding movement by operation of said servo motor, said slide block having a support lug on the lower end thereof;

a load cell positioned between said slide block and said nut of said ball screw for measuring load applied to said nut;

a rotary encoder for detecting the position of said slide block by detecting the number of revolutions of said servo motor;

control means for controlling the operation of said servo motor based on the position of said slide block detected by said rotary encoder and the load applied to said nut and measured by said load cell; and a hem roller rotatably mounted to said support lug.

* * * * *